US008008238B2

(12) United States Patent
Malet et al.

(10) Patent No.: US 8,008,238 B2
(45) Date of Patent: Aug. 30, 2011

(54) ODOR REDUCTION FOR AGENTS CONTAINING HYPOCHLORITE

(75) Inventors: Carlos Malet, Sant Boi de Llobregat (ES); Mercedes Mendoza Cruz, Barcelona (ES); Pilar Ibanez, Argentona (ES); Miguel Osset, Sant Pere de Vilamajor (ES)

(73) Assignee: Henkel AG & Co. KGaA, Duesseldorf (DE)

( * ) Notice: Subject to any disclaimer, the term of this patent is extended or adjusted under 35 U.S.C. 154(b) by 115 days.

(21) Appl. No.: 12/133,035

(22) Filed: Jun. 4, 2008

(65) Prior Publication Data

US 2008/0261839 A1 Oct. 23, 2008

Related U.S. Application Data

(63) Continuation of application No. PCT/EP2006/011890, filed on Dec. 11, 2006.

(30) Foreign Application Priority Data

Dec. 22, 2005 (DE) ..... 10 2005 062 008

(51) Int. Cl.

| | |
|---|---|
| ***C11D 1/90*** | (2006.01) |
| ***C11D 3/20*** | (2006.01) |
| ***C11D 3/26*** | (2006.01) |
| ***C11D 3/50*** | (2006.01) |

(52) U.S. Cl. ..... 510/101; 510/104; 510/106; 510/303; 510/383; 510/405; 510/435; 510/436; 510/499; 510/505; 510/506; 510/509; 510/511; 252/187.25; 252/187.26

(58) Field of Classification Search ..... 510/101, 510/104, 106, 303, 383, 405, 435, 436, 499, 510/505, 506, 509, 511; 252/187.25, 187.26
See application file for complete search history.

(56) References Cited

U.S. PATENT DOCUMENTS

| | | | | |
|---|---|---|---|---|
| 3,393,153 | A | 7/1968 | Zimmerer et al. | |
| 3,655,566 | A | 4/1972 | Robinson et al. | |
| 3,666,680 | A | 5/1972 | Briggs | |
| 3,876,551 | A | 4/1975 | Laufer et al. | |
| 4,113,645 | A | 9/1978 | DeSimone | |
| 4,116,849 | A | 9/1978 | Leikhim | |
| 4,193,888 | A | 3/1980 | McHugh | |
| 4,411,799 | A | 10/1983 | Ito et al. | |
| 4,828,723 | A | 5/1989 | Cao et al. | |
| 4,830,782 | A | 5/1989 | Broze et al. | |
| 5,139,695 | A | 8/1992 | Eckhardt | |
| 5,180,514 | A | 1/1993 | Farr et al. | |
| 5,185,096 | A | 2/1993 | Ahmed | |
| 5,229,027 | A | 7/1993 | Ahmed | |
| 5,972,038 | A | 10/1999 | Amestica et al. | |
| 6,083,892 | A | 7/2000 | Severns et al. | |
| 6,090,770 | A | 7/2000 | Mendoza et al. | |
| 6,204,235 | B1 | 3/2001 | Jimenez et al. | |
| 6,228,833 | B1 * | 5/2001 | Paatz et al. | 510/444 |
| 6,448,214 | B1 * | 9/2002 | Del Duca et al. | 510/372 |
| 6,448,215 | B1 | 9/2002 | Grande et al. | |
| 6,506,718 | B1 | 1/2003 | Todini | |
| 6,649,583 | B2 | 11/2003 | Todini | |
| 6,718,992 | B1 * | 4/2004 | Cardola et al. | 134/25.2 |
| 6,894,015 | B1 | 5/2005 | Briatore et al. | |
| 2003/0032565 | A1 | 2/2003 | Sivik | |
| 2003/0150064 | A1 * | 8/2003 | Nickel et al. | 8/115.51 |
| 2004/0023837 | A1 | 2/2004 | Zanardi | |
| 2004/0138078 | A1 * | 7/2004 | Clare et al. | 510/220 |
| 2004/0192576 | A1 | 9/2004 | Schmid et al. | |
| 2005/0101505 | A1 * | 5/2005 | Wood | 510/337 |
| 2005/0170982 | A1 * | 8/2005 | Boone et al. | 510/238 |

FOREIGN PATENT DOCUMENTS

| | | |
|---|---|---|
| DE | 2810187 | 9/1978 |
| DE | 3201460 | 8/1982 |
| DE | 4140830 | 6/1992 |
| DE | 19700799 | 7/1998 |
| DE | 19803054 | 7/1999 |
| DE | 19855329 | 6/2000 |
| DE | 102004020017 | 11/2005 |
| EP | 0079102 | 5/1983 |
| EP | 311175 | 4/1989 |
| EP | 0351947 | 1/1990 |
| EP | 439878 | 8/1991 |
| EP | 0462793 | 12/1991 |
| EP | 0565788 | 10/1993 |
| EP | 0606707 | 7/1994 |
| EP | 0622451 | 11/1994 |
| EP | 0812909 | 12/1997 |
| EP | 0867503 | 9/1998 |
| EP | 0903403 | 3/1999 |
| EP | 905223 | 3/1999 |
| EP | 0905225 | 3/1999 |
| EP | 931829 | 7/1999 |
| EP | 1001010 | 5/2000 |
| EP | 1348755 | 1/2003 |
| EP | 1391501 | 2/2004 |
| EP | 1462512 | 9/2004 |
| EP | 1462564 | 9/2004 |
| EP | 1614742 | 1/2006 |
| GB | 2271119 | 4/1994 |
| JP | 52069415 | 6/1977 |
| JP | 07233396 | 9/1995 |
| WO | WO9305136 | 3/1993 |
| WO | WO9407987 | 4/1994 |
| WO | WO9410280 | 5/1994 |
| WO | WO9706233 | 2/1997 |
| WO | WO9745523 | 12/1997 |
| WO | WO9915616 | 4/1999 |
| WO | WO9928427 | 6/1999 |
| WO | WO2004085590 | 10/2004 |
| WO | WO2004104157 | 12/2004 |
| WO | WO2006010089 | 1/2006 |
| WO | WO2006048104 | 5/2006 |

* cited by examiner

*Primary Examiner* — Gregory R Del Cotto
(74) *Attorney, Agent, or Firm* — David P. LeCroy

(57) ABSTRACT

The aim of the invention is to diminish the odor, often perceived as unpleasant, that is left behind on human skin, in particular on the hands as a result of contact with agents containing chlorine bleach after use of the agent. This was achieved by the use of odorants selected from the group comprising diphenylmethane, diphenyl oxide, 2-methyl naphtyl ether, and mixtures thereof.

6 Claims, No Drawings

ODOR REDUCTION FOR AGENTS CONTAINING HYPOCHLORITE

CROSS-REFERENCE TO RELATED APPLICATIONS

This application is a continuation under 35 U.S.C. Section 365(c) and 35 U.S.C. Section 120 of International Application No. PCT/EP2006/011890, filed Dec. 11, 2006. This application also claims priority under 35 U.S.C. Section 119 of German Patent Application No. DE 10 2005 062 008.6, filed Dec. 22, 2005. Both the International Application and the German Application are incorporated herein by reference in their entireties.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The present invention relates to the use of specific odorants in hypochlorite-containing bleaching agents in order to avoid the unpleasant odor of such agents on human skin, in particular on the hands, as a result of contact with the agent.

Effective cleaning is one of the requirements that influences consumer acceptance of such agents. This requires that agents having broad potential for spot removal be made available, which agents can, for example, remove oily and greasy stains from textiles or from hard surfaces such as floor tiles or wall tiles. In order to meet this requirement, agents containing (inter alia) hypochlorite bleaches have been developed, in which agents the hypochlorite contributes, as a strong oxidizing agent, to the chemical breakdown, destruction, and removal of the stains. A further advantage of using hypochlorite is that it acts as an effective disinfecting agent. One disadvantage that is perceived, however, is that after contact with human skin, which contact necessarily occurs when such agents are used with bare hands and cannot always be avoided even otherwise, for example when gloves are used, an odor occurs that clings to the skin and cannot always be entirely removed even after repeated washing with water.

(2) Description of Related Art, Including Information Disclosed Under 37 C.F.R. Sections 1.97 and 1.98

To remedy this, it has been proposed, for example in European Patent Application EP 439 878, to use a volatile perfume composition.

European Patent Application EP 0 606 707 describes agents that contain a polymer component together with a hypochlorite compound, and that lead to a decrease in unpleasant odors of the agent itself and of surfaces cleaned therewith. This could also be attributed to the high viscosity of said agents, so that compounds that are responsible for the disadvantageous odor are possibly enclosed in vesicles.

In the aforesaid existing art, greater emphasis was therefore placed on avoiding disadvantageous odors of the actual agent and of the surfaces cleaned therewith, and less attention was paid to the problem of odor formation on skin surfaces that have come into contact with the agent.

European Patent Application EP 0 812 909 A1 describes the use of polycarboxylate polymer in hypochlorite-containing bleaching agents to avoid unpleasant odors that result from contact by such agents with skin surfaces.

European Patent Application EP 0 622 451 also deals with the matter of odor formation during and after the use of chlorine-containing agents, and proposes using a perfume. The difficulty encountered here is that, on the one hand, only a few fragrances are stable in the presence of the strong oxidizing ability of chlorine-based bleaching agents, and on the other hand, the odor of chlorine is very strong and is difficult to mask using a perfume. EP 0 622 451 proposes using, in such agents, 0.000002 wt % to 2 wt % bleach-stable fragrances, selected from the classes of the acetals, aldehydes, esters, alcohols, ketones, ethers, nitrites, and terpenes.

BRIEF SUMMARY OF THE INVENTION

Surprisingly, it has now been found that a combination of specific odorants is particularly well suited for decreasing the odor associated with chlorine bleach on human skin that has come into contact with agents containing chlorine bleach.

The subject matter of the present invention is the use of odorants to diminish the odor of chlorine bleach on human skin that has come into contact with said chlorine bleach, the odorant being selected from the group comprising diphenylmethane, diphenyl oxide, 2-methyl naphtyl ether, and mixtures thereof. In a preferred aspect of the use, the skin is on a human hand.

BRIEF DESCRIPTION OF THE SEVERAL VIEWS OF THE DRAWING(S)

Not Applicable

DETAILED DESCRIPTION OF THE INVENTION

The odorant by preference comprises a combination of diphenylmethane and diphenyl oxide at a weight ratio from 1:1 to 1:50, in particular from 1:10 to 1:5. It furthermore preferably comprises a combination of diphenylmethane and 2-methyl naphthyl ether at a weight ratio from 50:1 to 1:10, in particular from 5:1 to 1:1. It is also preferred if the odorant comprises a combination of diphenyl oxide and 2-methyl naphthyl ether at a weight ratio from 250:1 to 1:1, in particular from 50:1 to 5:1.

The aforesaid odorant can be applied as such or in the form of a preparation that contains it, after use of the chlorine-containing agent, onto the skin areas that have come into contact with said agent. It is preferred, however, if the odorant is already part of the composition that contains the chlorine bleach.

The composition is by preference an aqueous liquid that is applied, undiluted or if applicable after mixing with water, onto a textile surface or hard surface, and that contains 0.5 wt % to 10 wt %, in particular 1 wt % to 6 wt %, alkali-metal hypochlorite, in particular sodium hypochlorite. A liquid water-containing bleaching agent containing alkali-metal hypochlorite and odorant, the odorant being selected from the group comprising diphenylmethane, diphenyl oxide, 2-methyl naphthyl ether, and mixtures thereof, is a further subject of the invention.

A further subject of the invention is a method for bleaching stains on textiles and/or on hard surfaces, in which method a composition according to the present invention is used.

An agent according to the present invention contains by preference 0.0005 wt % to 0.005 wt % diphenylmethane, 0.005 wt % to 0.025 wt % diphenyl oxide, and/or 0.0001 wt % to 0.005 wt % 2-methyl naphthyl ether.

A composition according to the present invention that is also utilized in the context of the use according to the present invention contains by preference 0.1 wt % to 2 wt % alkali-metal hydroxide and up to 5 wt % bleach-stable surfactant, in particular betaine and/or alkyl ether sulfate.

Particularly preferred among the betaines are those of the general formula (I)

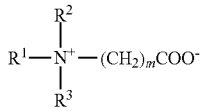

(I)

in which $R^1$ is an alkyl or alkenyl group having 6 to 22 carbon atoms or an $R^4CO—NH—(CH_2)_n$ group, $R^2$ is hydrogen or an alkyl group having 1 to 4 carbon atoms, $R^3$ is hydrogen or an alkyl group having 1 to 4 carbon atoms, $R^4$ is an alkyl or alkenyl group having 6 to 22 carbon atoms, m is a number from 1 to 6, and n is a number from 1 to 3. Examples of particularly suitable representatives of this class of surfactants encompass $C_{12-18}$-alkyl dimethyl betaine, commercially obtainable as coco betaine, and $C_{10-16}$-alkyl dimethyl betaine, commercially obtainable as lauryl betaine. A further class of particularly preferred surfactants are the alkyl ether sulfates, which are obtainable by reacting alcohols (preferably having 6 to 22 carbon atoms) with alkylene oxides, in particular ethylene oxide, and subsequent sulfatizing and neutralization, in particular a $C_{12-14}$ fatty alcohol ether sulfate alkoxylated with 2 equivalents of ethylene oxide. The corresponding cation in the ether sulfates is preferably sodium. Surfactants, if present, are preferably contained in quantities of up to 5 wt %, in particular from 0.01 wt % to 3 wt %, in agents stabilized according to the present invention.

The preparations can additionally contain sequestering agents, by preference alkylphosphonic acids, and among the latter especially those having at least one amine oxide substituent on the alkyl group (referred to here as amine oxide phosphonic acids), polyacrylic acids, and/or polyacrylic acids comprising phosphono groups, which acids can also be present in the form of their alkali salts. The incorporation of such complexing agents results, surprisingly, in a particularly good shine retention on treated hard surfaces. This is not observed when other complexing agents, for example methylglycinediacetic acid or nitrilotriacetic acid, are used instead. Amine oxide phosphonic acids are normally manufactured by oxidation of aminoalkylphosphonic acids. They preferably belong to the group of compounds according to the general formula (II)

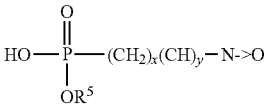

(II)

in which $R^5$ is hydrogen, a $—(CH_2)_x(CHCH_3)_y—NH_2$->O group, or an alkali metal, x is a number from 1 to 4, and y is 0 or 1. Among the particularly preferred amine oxide phosphonic acids is the amine oxide based on aminotrimethylenephosphonic acid. By preference, 0.01 wt % to 2 wt % of such sequestering agents is present.

The agents contain by preference 0.5 wt % to 2 wt % silicate, in particular alkali-metal silicate, and/or 0.1 wt % to 2 wt % carbonate, in particular alkali-metal carbonate.

The agents according to the present invention can easily be manufactured by mixing the aforementioned ingredients in the quantities indicated.

The invention claimed is:

1. An aqueous liquid bleaching agent containing comprising:

alkali-metal hypochlorite, at least a bleach-stable surfactant in an amount of 0.01 wt. % to 5 wt. %, wherein the surfactant is at least a betaine surfactant of general formula (I)

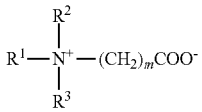

(I)

wherein $R^1$ is an alkyl or alkenyl group having 6 to 22 carbon atoms or an $R^4CO—NH—(CH_2)_n$ group, $R^2$ is hydrogen or an alkyl group having 1 to 4 carbon atoms, $R^3$ is hydrogen or an alkyl group having 1 to 4 carbon atoms, $R^4$ is an alkyl or alkenyl group having 6 to 22 carbon atoms, m is a number from 1 to 6, and n is a number from 1 to 3, and odorant, wherein the odorant is selected from the group consisting of a combination of 0.0005 wt % to 0.005 wt % diphenylmethane and 0.005 wt % to 0.025 wt % diphenyl oxide in a weight ratio of from 1:1 to 1:50, a combination of 0.0005 wt % to 0.005 wt % diphenylmethane and 0.0001 wt % to 0.005 wt % 2-methyl naphthyl ether in a weight ratio of from 50:1 to 1:10, and a combination 0.005 wt % to 0.025 wt % of diphenyl oxide and 0.0001 wt % to 0.005 wt % 2-methyl naphthyl ether in a weight ratio of from 250:1 to 1:1.

2. The agent according to claim 1, wherein it contains 0.5 wt % to 10 wt % alkali-metal hypochlorite.

3. The agent according to claim 1, wherein it contains 0.1 wt % to 2 wt % alkali-metal hydroxide.

4. The agent according to claim 1, wherein it contains 0.5 wt % to 2 wt % silicate, 0.0125% to 2 wt % of an acid or salt selected from the group consisting of alkylphosphonic acid and/or phosphonate, amine oxide phosphonic acid, polyacrylic acid containing phosphono groups, and/or an alkali-metal salt of one or both of the acids, and/or 0.1 wt % to 2 wt % carbonate.

5. The agent according to claim 1 further comprising an alkyl ether sulfate bleach-stable surfactant, wherein the total amount of surfactant in the agent is no greater than 5 wt. %, based on total weight of the agent.

6. The agent according to claim 1, wherein the betaine surfactant is a coco betaine or a lauryl betaine.

* * * * *